United States Patent [19]

Reichman et al.

[11] Patent Number: 4,691,790

[45] Date of Patent: Sep. 8, 1987

[54] METHOD AND APPARATUS FOR REMOVING THE INNER CONDUIT FROM A DUAL PASSAGE DRILL STRING

[75] Inventors: James M. Reichman, Issaquah; Michael C. McDonald, Summer, both of Wash.; T. B. O'Brien, Midland, Tex.

[73] Assignee: Flowdril Corporation, Kent, Wash.

[21] Appl. No.: 708,245

[22] Filed: Mar. 5, 1985

Related U.S. Application Data

[63] Continuation-in-part of Ser. No. 661,368, Oct. 16, 1984, Pat. No. 4,624,327.

[51] Int. Cl.[4] ..... E21B 7/18; E21B 17/18; F16L 17/00

[52] U.S. Cl. ..... 175/67; 175/215; 175/320; 285/376

[58] Field of Search ..... 175/320, 215, 57, 65, 175/67; 166/377; 285/18, 140–143, 401, 402, 376, 133 R

[56] References Cited

U.S. PATENT DOCUMENTS

| | | | |
|---|---|---|---|
| 1,338,460 | 5/1920 | Morrison . | |
| 1,512,140 | 7/1923 | Schaub . | |
| 1,585,969 | 5/1926 | Ferguson . | |
| 1,716,245 | 6/1929 | Shaw | 285/143 |
| 2,258,001 | 10/1941 | Chamberlain . | |
| 2,720,381 | 10/1955 | Quick . | |
| 3,112,800 | 12/1963 | Bobo . | |
| 3,273,660 | 9/1966 | Jackson et al. | 175/57 |
| 3,489,438 | 1/1970 | McClure | 175/215 X |
| 3,664,443 | 5/1972 | Campbell | 175/215 X |
| 3,677,355 | 7/1972 | Elenburg | 175/215 |
| 3,786,878 | 1/1974 | Chapman | 175/215 X |
| 3,839,875 | 10/1974 | Matsushita . | |
| 3,851,490 | 10/1974 | Matsushita . | |
| 3,871,486 | 3/1975 | Curington et al. | 175/215 X |
| 4,012,061 | 3/1977 | Olson | 285/142 X |
| 4,280,723 | 7/1981 | Moldestad | 285/376 |
| 4,458,766 | 7/1984 | Siegel . | |

FOREIGN PATENT DOCUMENTS

| | | | |
|---|---|---|---|
| 933146 | 9/1973 | Canada . | |
| 1274537 | 8/1968 | Fed. Rep. of Germany | 175/215 |

OTHER PUBLICATIONS

Walker-Neer Catalog, "Con-Cor Dual Conduit Drill Pipe and Tools", p. 7602.

*Primary Examiner*—Stuart S. Levy
*Assistant Examiner*—Thomas R. Hannon
*Attorney, Agent, or Firm*—Knobee, Martens, Olson & Bear

[57] ABSTRACT

A dual conduit drill string used in drilling holes for geothermal, oil and gas wells, and the like, comprises a removable inner conduit to permit the use of salvage or repair equipment within the outer conduit. The outer conduit comprises standard API drill pipe sections which are each slightly modified to receive the removable inner conduit sections. Each inner conduit section is provided with flexible hangers for suspending the weight of the inner conduit from a support ledge formed on the interior surface of the drill pipe. The hangers permit upward removal motion and rotation of the inner conduit with respect to the drill pipe, but prevent downward motion. Individual inner conduit sections are joined together at lockable stab joints in which locking is accomplished by the rotatable engagement of a key and locking socket. Preferably, the inner conduit is manufactured in uniform lengths and mounted in drill pipe sections of non-uniform lengths by means of drill pipe adaptor subs. In addition, a removal tool can be used to remove the inner conduit from the drill pipe by engaging the hangers of the lowest inner conduit.

19 Claims, 11 Drawing Figures

METHOD AND APPARATUS FOR REMOVING THE INNER CONDUIT FROM A DUAL PASSAGE DRILL STRING

RELATED APPLICATION

The present application is a continuation-in-part of U.S. application Ser. No. 661,368, filed Oct. 16, 1984, now U.S Pat. No. 4,624,327 entitled "Method and Apparatus for Combined Jet and Mechanical Drilling."

BACKGROUND OF THE INVENTION

The present invention relates to a method and apparatus for easily and quickly removing the inner conduit of a dual passage drill string used in drilling geothermal, gas, or oil wells, and, more particularly, to a system and method for removing an inner conduit which is used to deliver high pressure fluid to a drill bit in combined mechanical and jet drilling operations. Although the invention is described herein in connection with geothermal, gas, and oil well drilling, the principles and concepts disclosed apply equally to other forms of drilling and mining.

In oil and gas well drilling, the cost of equipment and labor is extremely high. In order to minimize the cost of this phase of oil and gas production, it is desirable to drill wells through earthen formations as rapidly as possible, commensurate with good drilling practices. However, in harder formations, which are more difficult to drill, there are a number of operating problems that tend to make the cost of such holes more expensive.

In order to increase the drilling rate of deep, hard-to-drill wells, new technology has been developed. For example, it has been shown in previous tests that high pressure fluid jets at 12,000 pounds per square inch (PSI) or more at the drill bit can significantly increase drilling rates. Previously, this high pressure fluid was delivered to the drill bit by pressurizing the entire drilling fluid stream (or "mud"), and conducting it to the drill bit through standard drilling pipe having improved seals at their connections. However, the costs associated with raising such a large volume of fluid to high pressures, together with the increased internal pressures on the seals and drill pipe connections, led to drill pipe failures, significant down time, and increased costs, even though drilling rates were higher. Thus, these attempts at jet drilling proved to be impractical.

Recently, Flow Industries, Inc., assignee of the present application, devised a dual conduit approach for successfully utilizing the principles of jet drilling. In this approach, described in more detail and claimed in copending application Ser. No. 661,368, U.S. Pat. No. 4,624,327, filed Oct. 16, 1984, and entitled "METHOD AND APPARATUS FOR COMBINED JET AND MECHANICAL DRILLING", which is hereby incorporated by reference, a high pressure liquid is conducted via an inner conduit to the drilling bit to provide either a jet assisted mechanical drill or a mechanically assisted jet drill. The drilling mud is delivered to the drill bit in the annulus between the inner conduit and the outer conduit or standard drill pipe. This approach overcomes the problems faced in previous jet drilling methods, although it does require a dual conduit drill string.

Dual conduit drill string presently available is manufactured so that the inner conduit is an integral part of the outer drill pipe, and is therefore unremovable with respect thereto. Thus. it is impossible to pull the inner conduit out of the outer drill pipe while the latter remains in the well. This situation is a serious disadvantage under certain conditions where servicing or repair of the drill pipe is necessary.

Occasionally, the drill pipe breaks. In order to reduce cost, as much of the drill string as possible is salvaged. Thus, the drill string must be cut off at the appropriate depth and removed. In order to accomplish this salvaging operation, certain tooling must be inserted down into the drill pipe. With the inner conduit in place, however, the salvage operation is severely hampered. On other occasions, the drill pipe may be stuck in the hole and cannot be moved either way. A small explosive charge may then be detonated in the hole in order to break the drill pipe at a threaded connection, again in order to save as much of the drill pipe as possible. At other times, articles become caught in the drill pipe and must be fished out. In all of these situations, the existence of the inner conduit in the drill pipe impedes and sometimes prevents the salvage or repair operation.

Thus, there is a need for a dual passage drill string in which the inner conduit can be removed independent of the drill pipe.

SUMMARY OF THE INVENTION

The present invention fulfills this need by providing an inner conduit having a resilient hanger mechanism which permits upward vertical movement and rotation with respect to the outer drill pipe, but which prevents downward vertical movement. The dual passage drill string is assembled into the hole in the normal fashion but, under emergency situations, the inner conduit alone can be removed from the hole leaving the drill pipe. An important advantage of the present invention is that the removable inner conduit can be adapted for use with standard drill pipe sections manufactured in accordance with accepted petroleum industry standards, in particular, the standards set forth by the American Petroleum Institute (API).

Standard API drill pipe is manufactured in sections and assembled by means of threaded connections at the well head. The assembled sections then form a drill string which extends to the drill bit in the hole being drilled. In order to adapt the standard API drill pipe sections for use with the removable inner conduit of the present invention, the upper or female end of the drill pipe is counterbored slightly to provide a support ledge. This ledge supports the weight of the inner conduit section associated with each drill pipe section. The inner conduit is literally suspended from the drill pipe at this location. Likewise, the inner conduit is provided with a hanger mechanism which engages the ledge in order to support the weight of the inner conduit within the drill pipe section. The hanger mounted on the inner conduit permits upward movement of the inner conduit relative to the outer drill pipe, as well as rotation, but prevents downward movement with respect thereto. This permits the removal of the inner conduit without removing the drill pipe. The opposite end of the inner conduit is also provided with a guide or centering mechanism which maintains the concentric position of the inner conduit within the annulus of the drill pipe.

The hangers for the inner conduit are preferably constructed from a flat steel material and are carefully machined to close tolerances so that they will appropriately engage the support ledges. The hangers are flexible in a direction toward the inner conduit to permit the removal of the inner conduit through narrow drill pipe passageways, but sufficiently rigid to prevent the downward movement of the inner conduit beyond the location of the support ledge. Preferably three or four of the hangers are utilized on each inner conduit section, although other quantities or configurations can also be successfully utilized in the hanger mechanism.

Each inner conduit section is assembled within a drill pipe section for use in forming the overall drill string. The inner conduit is dimensioned such that, as an upper drill pipe section is threadedly engaged with a lower drill pipe section, the lower end of the inner conduit of the upper drill pipe section simultaneously mates with the upper end of the inner conduit of the lower drill pipe section. These two mating ends of the inner conduit engage in a stab joint which is sealed by a pair of annular seals. Because the hangers on the lower inner conduit prevents downward movement, a secure stab joint connection can be made as the drill pipe sections are connected.

Thus, an important advantage of the present invention is that the drill pipe sections are assembled in a normal fashion, just as a single passage drill string is assembled. If it should become necessary to remove the inner conduit from the drill string, the inner conduit sections are rotated relative to the outer drill pipe, which remains in place, and the inner conduit is lifted out. The rotation of the inner conduit, which is permitted by the hanger/support ledge engagement, causes the individual sections of inner conduit to lock onto one another at their joints by means of a locking socket or key lock.

Standard API drill pipe sections are manufactured in lengths varying from approximately 27 to 32 feet. In order to permit the manufacture of removable inner conduits of a uniform length, another aspect of the present invention comprises adaptor subassemblies for modifying the length of the drill pipe. The adaptors can be attached to the standard API drill pipe at their upper ends and are counterbored to provide the support ledge from which the hangers of the inner conduit are suspended. In yet another aspect of the present invention, if the inner conduit should become damaged or, for whatever reason, should fail to lock together, a removal tool can safely and quickly remove the entire inner conduit from the drill string. This removal tool comprises a hollow pipe having a tapered nose and circumferential lip at its distal end. The removal tool is inserted into the drill string so as to be concentric with the inner conduit and in the annulus between the inner conduit and the outer drill pipe. The pipe causes the hangers to flex inwardly so that the tapered nose is passed below the hangers at the point of removal. The hangers then spring outward again to engage the lip. The removal tool can then be lifted from the drill pipe, at the same time lifting the entire inner conduit string from the hole.

DETAILED DESCRIPTION OF THE INVENTION

Figure 1:
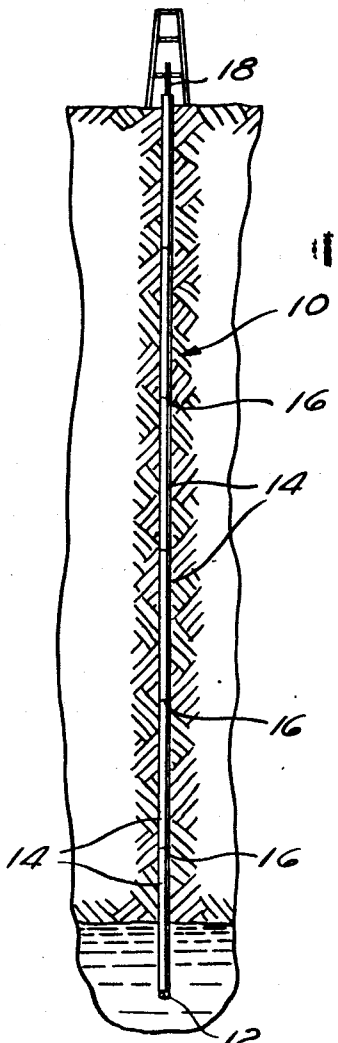
FIG. 1 is an overall perspective view of the dual passage drill string of the present invention which is used in a variety of drilling operations, with the outer drill pipe partially cut away to reveal the removable inner conduit.

FIG. 1 illustrates a standard drill string 10 and drill bit 12 used in the drilling of holes for geothermal, gas, oil, and other wells. The drill string 10 is suspended from the support structure at the top of the well (not shown) and is rotated by machinery in order to permit the drill bit 12 to advance the depth of the hole. The drill string 10 shown in FIG. 1 is comprised of a series of interconnected drill pipe sections 14 which are threadably connected at the drill pipe joints 16. These drill pipe sections 14 are manufactured in accordance with standards set forth by the American Petroleum Institute (API) and come in lengths ranging from 27–32 feet.

As shown in FIG. 1, the present invention contemplates a removable, high pressure inner conduit 18 situated within the outer drill pipe 14 for delivering a high pressure fluid to the drill bit 12 for use as a jet drill. In accordance with standard drilling practices, the drilling fluid or "mud" is delivered to the drill bit 12 in the annulus between the inner conduit 18 and the drill pipe 14. The high pressure fluid and drilling mud mix at the bottom of the hole and are forced upward at low pressure in the annulus between the drill pipe 14 and the casing of the hole. As explained above, it is occasionally necessary, sometimes under emergency conditions, to conduct certain maintenance or salvage operations on or in the drill pipe 14. Under these conditions, it is an important advantage to be able to remove the inner conduit 18 independently of the outer drill pipe 14.

Figure 2:
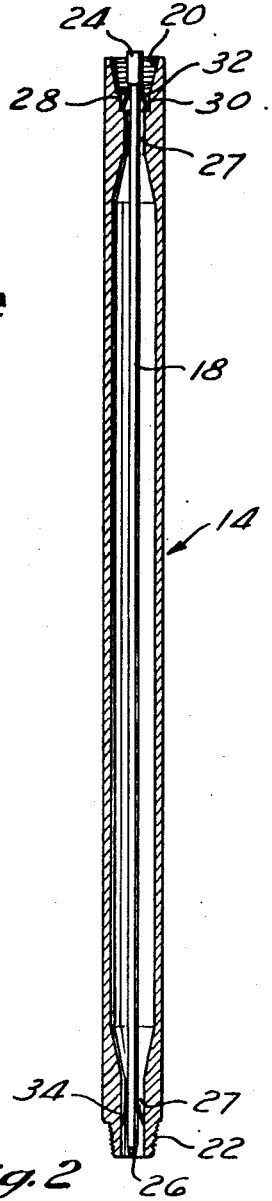
FIG. 2 is a cross-sectional view of a standard drill pipe section which has been slightly modified to receive the removable inner conduit of the present invention.

FIG. 2 illustrates a standard API drill pipe section 14 which has been modified to receive the removable inner conduit 18 of the present invention. The drill pipe section 14 is comprised of an upper female threaded connector 20 and a lower male threaded connector 22. The inner conduit 18 also has an upper female connector 24 and a lower male connector 26. As the depth of the hole increases, additional drill pipe sections are added to the drill string at the top of the hole by means of these threaded connections 20 and 22. At the same time, the inner conduits 18 associated with each drill pipe section 14 form a lockable stab joint connection by means of these connectors 24 and 26, the details of which will be described below. As shown in FIG. 2, the walls of the drill pipe 14 are thickened in the vicinity of the threaded ends 20 and 22 to provide additional strength and support for the joint connections. These thickened wall areas produce a relatively narrower passageway 27 at each end.

The standard API drill pipe 14 shown in FIG. 2 is modified by counterboring or drilling the upper passageway 27 as indicated at 28 to provide an annular support ledge 30. The removable inner conduit 18 is provided with a plurality of hangers 32, two of which are illustrated in FIG. 2. Preferably, the hangers 32 comprise finger-like, flat metallic springs which engage the support ledge 30, thereby suspending the inner conduit 18 within the drill pipe 14. The hangers 32, of which there may be three, four or more associated with each inner conduit section, are rigidly attached to the inner conduit 18 whose weight is supported by the engagement between the hangers and the support ledge 30. The hangers 32 are sufficiently rigid to support the weight of the inner conduit 18 without flexing, thereby preventing the downward movement of the inner conduit 18. However, if necessary, the hangers 32 can flex inwardly, toward the inner conduit 18, in order to permit the removal of the inner conduit string through passageways 27 which have a smaller diameter than that of the support ledge 30. The length and taper of each hanger 32 also facilitates this removal and inward flexing. That is, the length of each hanger 32 is approximately twice the greatest distance that the hanger extends away from the inner conduit. The hangers 32 also serve to center the inner conduit 18 within the drill pipe 14, a function which is accomplished at the lower end of the inner conduit by the centering guides 34. Each centering guide 34 is constructed similarly to the hangers 32 and engage the narrow passageway 27 at the bottom of the drill pipe 14.

Figure 5:
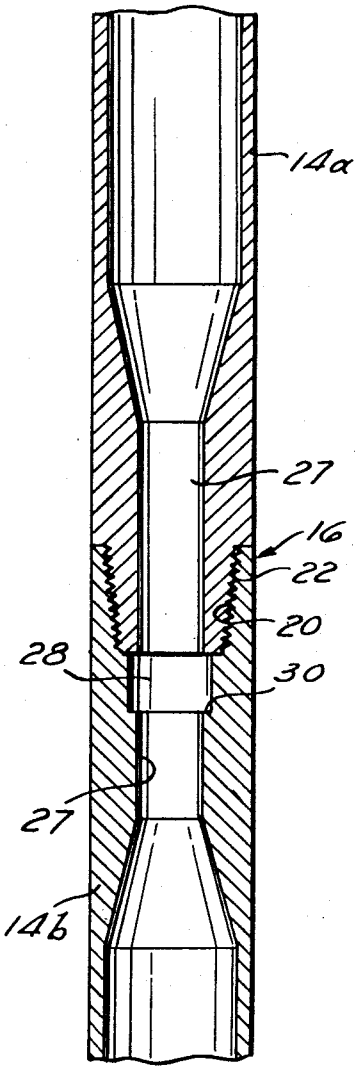
FIG. 5 is similar to FIGS. 3 and 4 and illustrates in cross-section a drill pipe joint with the inner conduit completely removed.
Figure 4:
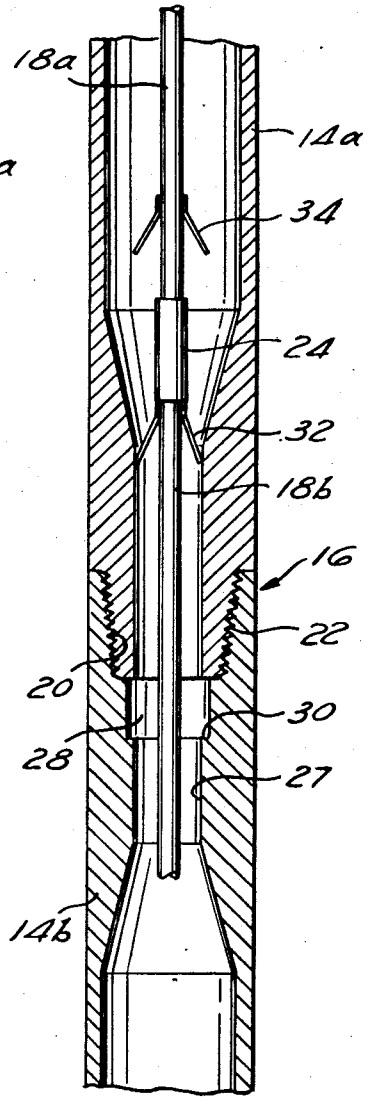
FIG. 4 is similar to FIG. 3 and illustrates in cross-section a drill pipe joint with the inner conduit being subjected to an upward removal force.
Figure 3:
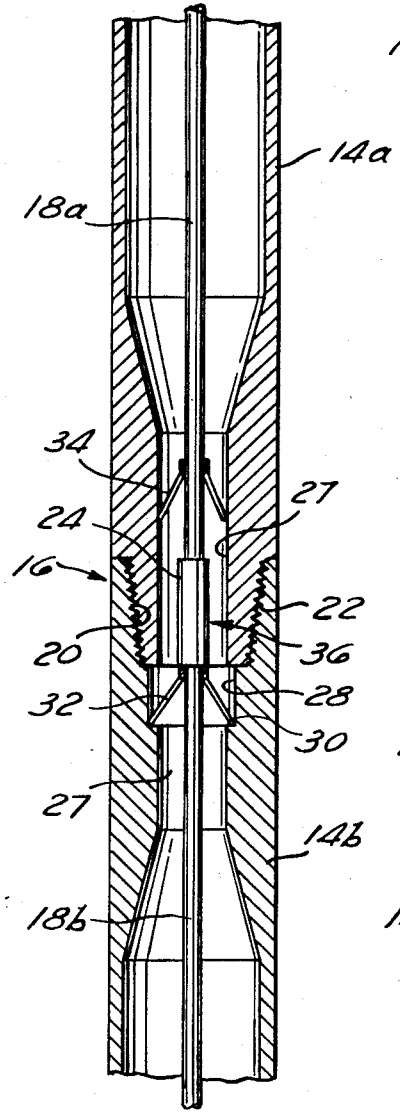
FIG. 3 is a cross-sectional view of a threaded drill pipe joint illustrating the removable inner conduit therein and the lockable stab joint formed between a pair of inner conduit sections.

FIGS. 3–5 illustrates the manner in which the inner conduit can be removed from the drill string. FIG. 3 illustrates a threaded drill pipe joint 16 formed between the male connector 22 of an upper drill pipe section **14*a* and the female connector 20 of a lower drill pipe section 14*b*. As this drill pipe joint 16 was formed, a stab joint 36 was formed between the male connector 26 (not shown in FIG. 3) of an upper inner conduit 18*a* and the female connector 24 of a lower inner conduit 18*b* in a manner described below in relation to FIG. 6. The lower inner conduit 18*b* is shown suspended within the lower drill pipe 14*b* by means of hangers 32 and ledge 30. The upper conduit 18*a* is shown centered in the upper drill pipe section 14*a* by means of guides 34**.

It will be appreciated from FIG. 3 that the hangers 32 and centering guides 34 will permit the inner conduit 18 to move upward and rotate relative to the drill pipe 14 without affecting the latter's position. When the inner conduit 18 is subjected to an upward force, as shown in FIG. 4, the hangers 32, due to their flexible nature, can spring inward toward the inner conduit 18 in order to pass through the narrow passageways 27 of the drill pipe sections 14. FIG. 5 illustrates the remaining drill pipe sections 14 after the inner conduit 18 has been completely removed.

A related advantage of the present invention is that it accommodates differences in expansion between the inner conduit 18 and drill pipe 14. Also, because different loads are exerted on each, the relative motion of the one with respect to the other accommodates such changes and relieves any unnecessary stress on the sections or joints 16 and 36. At the same time, lugs or other appropriate devices can be added to the hanger/support ledge interconnection in order to prevent unnecessary relative rotation between the inner conduit 18 and drill pipe 14.

Figure 6:
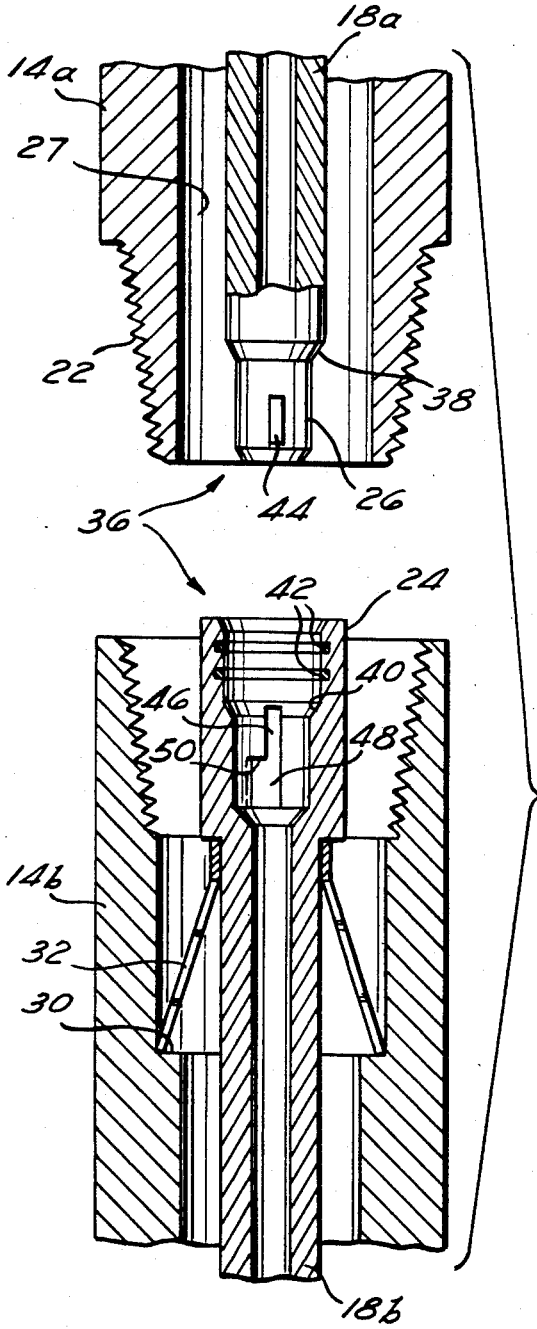
FIG. 6 is an exploded partial cross-sectional view of the drill pipe joint illustrating the details of the hangers and the lockable stab joint of the inner conduit.

FIG. 6 illustrates in greater detail the hangers 32 utilized to suspend the inner conduit 18 from the support ledge 30 in the drill pipe 14 and the stab joint connection 36 between the mating ends of the inner conduit 18. FIG. 6 comprises an exploded view of the drill pipe joint 16 in which the male connector 22 of the upper drill pipe **14*a* and associated inner conduit 18*a* is about to be engaged with the female connector 20 of the lower drill pipe 14*b* and its associated inner conduit 18*b*. The lower inner conduit 18*b* is shown supported on the support ledge 30 by means of the hangers 32, thereby suspending the inner conduit 18*b* within the lower drill pipe 14*b*. As the upper drill pipe 14*a* is threadably engaged in the lower drill pipe 14*b*, the male connector 26 of the upper inner conduit 18*a* also engages the female connector 24 of the lower inner conduit 18*b* to form the stab joint 36. In completing this connection, the beveled edge 38 near the end of the male connector 26 on the inner conduit 18*a* seats against the beveled edge 40 on the female connector 24 to form the stab joint 36. A pair of annular, static seals 42 are embedded in the inner walls of the female connector 24 in order to prevent leakage of the high pressure fluid in the inner conduit 18**. In addition, the mating ends of the inner conduit are provided with a dynamic seal.

Figure 7:
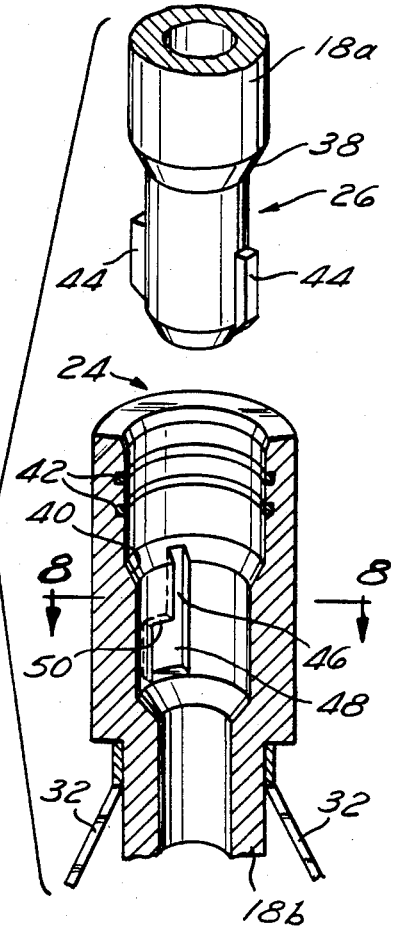
FIG. 7 is an exploded perspective view of the mating members of the inner conduit stab joint and illustrating the locking mechanism for said joint.
Figure 8:
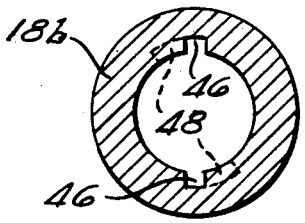
FIG. 8 is a cross-sectional view of the female member of the inner conduit stab joint illustrating the keyway and locking socket.

In order to provide a lockable stab joint 36, a pair of keys 44 (only one of which is visible in FIG. 6) are formed on the lower end or male connector 26 of the inner conduit **18*a* which engage a keyway 46 and a locking socket 48 formed on the interior surface of the female connector 24 of the lower inner conduit 18*b*. These mating elements are also shown in the exploded perspective view of FIG. 7 and the keyway 46 and locking socket 48 are shown in the cross-section of FIG. 8. When the stab joint 36 is completed, the keys 44 are inserted into a pair of longitudinal keyways 46 formed on the inner surface of the female connector 24. Adjacent each keyway 46 is a locking socket 48 which is capable of receiving the key 44 on the male connector 26 when the later is rotated. The socket 48 forms a shoulder 50 which locks the key 44 beneath it and prevents the upper inner conduit 18*a* from being lifted or removed without lifting the lower inner conduit 18*b***.

Thus, this mechanism locks the stab joint 36 in order to permit the removal of the entire inner conduit string 18 from the drill pipe 14. Until it is necessary to remove the inner conduit 18, the stab joint can remain unlocked; that is, non-rotated. However, if an emergency situation arises, or for maintenance purposes, the inner conduit must be removed, this can be accomplished simply by beginning the rotation of the uppermost inner conduit section. This will in turn cause a sequential locking of the inner conduit stab joint connections so that the entire inner conduit string will be locked together and can be completely removed.

Figure 9:
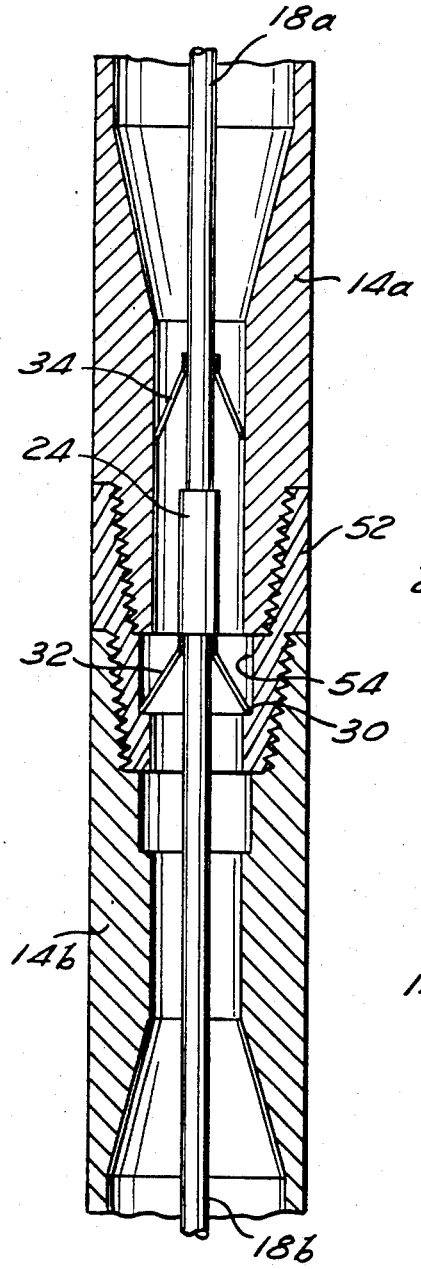
FIG. 9 is another cross-sectional view of a threaded drill pipe joint which has been modified to receive an adapter sub for providing a drill pipe section of a uniform length.

FIG. 9 illustrates that aspect of the present invention which permits the removable inner conduit to be constructed in uniform length. Because standard drill pipe sections are not manufactured in uniform lengths, an adaptor subsection 52 is provided which can be threadably engaged with the upper end of the drill pipe section in order to bring it up to a length which is uniform with the inner conduit sections. This adapter 52 is simply threaded onto the lower drill pipe section 14*b* as any other drill pipe section. The passageway 54 in the adapter 52 is also counterbored to form a support ledge 30 which receives the hangers 32 of the inner conduit 18*b*.

Figure 10:
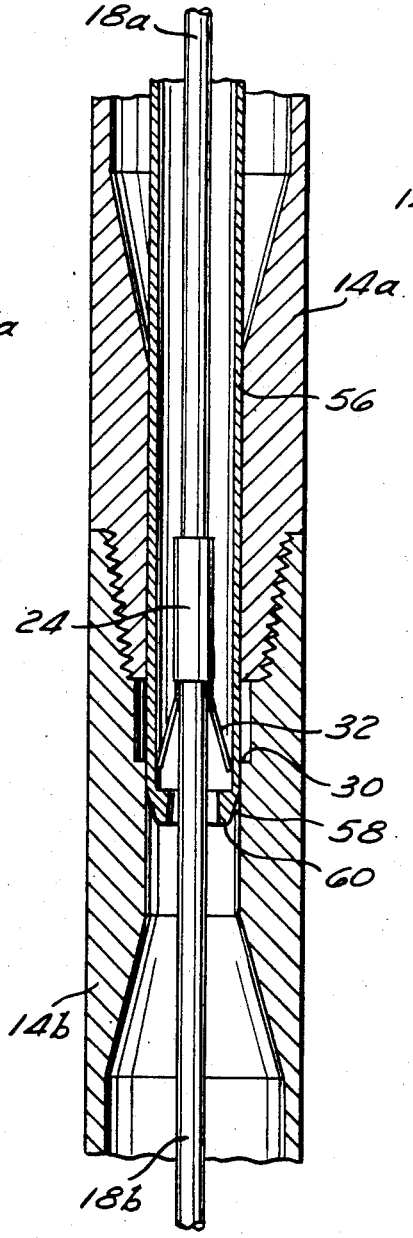
FIG. 10 is a partial cross-sectional view of a drill pipe joint illustrating the use of a removal tool.
Figure 11:
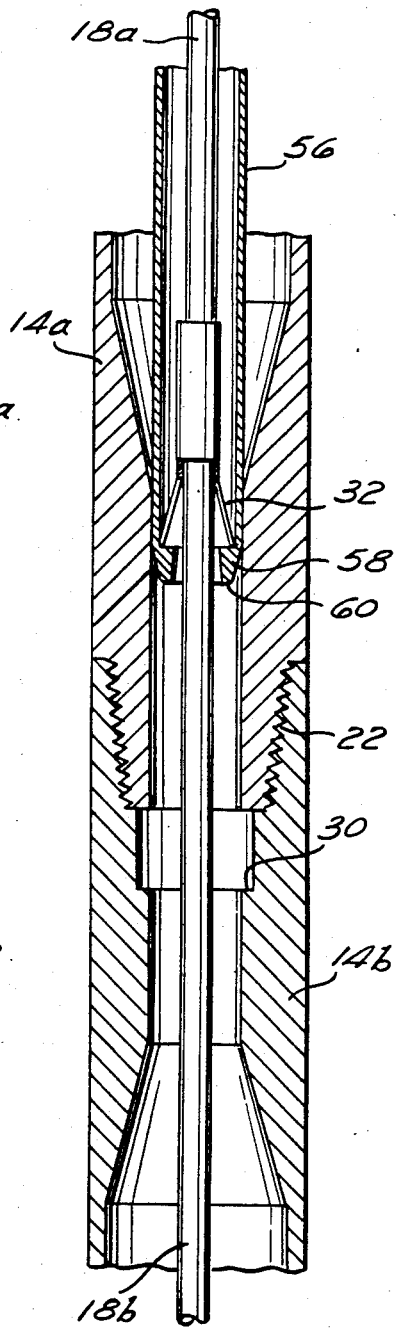
FIG. 11 is similar to FIG. 10 and illustrates the removal of the inner conduit by means of the removal tool.

FIGS. 10 and 11 illustrate an alternate removal device and method for removing the inner conduit 18 from the drill pipe 14. If a stab joint 36 of the inner conduit 18 should be unlockable for any reason or fractured, the inner conduit 18 may still be removed by means of a rigid removal pipe or tool 56 which is inserted into the annulus between the inner conduit 18 and the drill pipe 14. This tool 56 is provided with a tapered nose 58 and circumferential lip 60. As the tool 56 is inserted down over the inner conduit 18, the lip 60 engages the hangers 32 and causes them to flex inward toward the inner conduit 18. The diameter of tapered nose 58 is less than that of the ledge 30, permitting the tool 56 to pass below the ledge 30. Thus, the lip 60 eventually passes below the hangers 32. The hangers 32 then flex outward again and engage the lip 60, as shown in FIG. 11. Thus, the removal tool 56 can be lifted upward, at the same time lifting the inner conduit string and removing it from the drill pipe.

In conclusion, the present invention provides a quick and simple method for removing the inner conduit from a dual passage drill string. At the same time, the lockable stab joint connection of the inner conduit can be utilized in association with the standard API drill pipe sections.

What is claimed is:

1. A method for removing the inner conduit from a dual conduit drill string used in drilling holes for geothermal, oil, and gas wells, and the like, to permit use of emergency or salvage procedures, comprising:

a. providing a standard drill pipe section;
b. modifying said standard drill pipe section to form an interior support;
c. engaging an inner conduit section with said interior support;
d. joining the modified drill pipe sections at joints to form a drill pipe string;
e. joining a plurality of said inner conduit sections at lockable joints to form an inner conduit string;
f. locking said lockable inner conduit joints; and
g. exerting an upward force on said inner conduit to remove the entire inner conduit string from said drill pipe string.

2. The method of claim 1, wherein said locking step comprises the step of rotating said inner conduit sections to lock one to another.

3. The method of claim 1, further comprising the step of centering said inner conduit section within said modified drill pipe section.

4. The method of claim 1, further comprising the step of modifying the length of said standard drill pipe section to conform to a uniform inner conduit length.

5. The method of claim 1, wherein said modifying step comprises the step of counterboring said standard drill pipe to form an interior ledge.

6. The method of claim 5, wherein said engaging step comprises the step of hanging said inner conduit from said interior ledge.

7. The method of claim 1, wherein said exerting step comprises the steps of:

a. placing a second conduit over said conduit;
b. connecting said second conduit to said inner conduit; and
c. lifting said second conduit.

8. The method of claim 1, wherein said engaging step utilizes flexible fingers on said inner conduit, and further comprising the step of flexing said fingers toward said inner conduit to permit removal of said inner conduit from said drill pipe string.

9. A removable inner conduit section adapted for use with an outer drill pipe section, said drill pipe section having a counterbored portion, comprising:

a conduit having upper and lower ends;

means on said conduit for engaging said drill pipe section to support the weight of said conduit within said drill pipe section, said engaging means providing an interference fit between said conduit and said counterbored portion of said drill pipe section, said engaging means being biased away from said conduit and toward said counterbored portion to permit upward movement of said conduit relative to said drill pipe section but preventing downward movment; and means on said upper and lower ends of said inner conduit for connecting said conduit to other similar conduits to form an inner conduit string, each of said similar conduits having engaging means to provide means for simultaneously removing said inner conduit string in an upward direction.

10. The removable inner conduit of claim 9, wherein said connecting means comprises means for locking said conduit to said other similar conduits to permit removal of said inner conduit string.

11. The removable inner conduit of claim 10, wherein said engaging means also permits rotation of said conduit with respect to said drill pipe section and wherein said locking means comprises rotatable locking means.

12. The removable inner conduit of claim 9, further comprising means for centering said conduit within said drill pipe section.

13. The inner conduit of claim 9 further comprising means for adapting the length of said outer drill pipe sections to conform to the length of said inner conduit.

14. A removable inner conduit adapted for use within the inner diameter of an outer drill pipe section used in drilling holes for geothermal, oil and gas wells, and the like, said inner conduit and drill pipe section forming a dual passage drill string section, comprising:

a conduit having an upper and lower end; and means on said conduit and extending therefrom for engaging said inner diameter of said drill pipe section to provide a removable interference fit with said drill pipe section for supporting said conduit within said drill pipe section, said interference fit being removable upon the upward movement of said conduit to permit said conduit to be upwardly removed from said drill pipe section.

15. The inner conduit of claim 14 wherein said means on said inner diameter comprises a ledge for receiving said engaging means, said ledge preventing the downward movement of said conduit with respect to said drill pipe section.

16. The inner conduit of claim 14 further comprising means for lifting said conduit from said drill pipe section.

17. The inner conduit of claim 16 wherein said lifting means comprises an outer conduit adapted for use within the inner diameter of said drill pipe section, said outer conduit having an upper and lower end, and means on the lower end of said outer conduit for engaging said engaging means of said inner conduit.

18. An inner conduit section used in the drilling of holes for geothermal, oil and gas wells, and the like, and adapted for attachment to a next adjacent upper conduit section and a next adjacent lower conduit section, each of said conduit sections having an upper end and lower end, said conduit sections forming an inner conduit string adapted for use with an outer drill string, comprising:

an upper end on said conduit for connecting said inner conduit to the lower end of said next adjacent upper inner conduit;

a lower end on said inner conduit for connecting said inner conduit to the upper end of said next adjacent lower inner conduit; and means on at least one of said ends for rotatably locking said inner conduit to said next adjacent inner conduit to provide means for removing said inner conduit string from said hole said locking means comprising a key and a keyway.

19. A method for removing the inner conduit from a dual conduit drill string used in drilling holes for geothermal, oil, and gas wells, and the like, to permit use of emergency or salvage procedures, comprising:

a. providing an outer conduit section;

b. positioning an inner conduit section within said outer conduit section by means of an interference fit;

c. joining a plurality of outer conduit sections at joints to form an outer conduit string;

d. joining a plurality of said inner conduit sections at lockable joints to form an inner conduit string;

e. locking said lockable inner conduit joints; and f. exerting an upward force on said inner conduit to remove the entire inner conduit string from said outer conduit string.

* * * * *